US008608150B2

(12) United States Patent
Okumura

(10) Patent No.: US 8,608,150 B2
(45) Date of Patent: Dec. 17, 2013

(54) SHEET POST-PROCESSING APPARATUS WITH BRANCHED HOLDING PATH

(75) Inventor: Keiji Okumura, Osaka (JP)

(73) Assignee: Kyocera Document Solutions Inc., Osaka (JP)

( * ) Notice: Subject to any disclaimer, the term of this patent is extended or adjusted under 35 U.S.C. 154(b) by 324 days.

(21) Appl. No.: 13/042,236

(22) Filed: Mar. 7, 2011

(65) Prior Publication Data

US 2011/0274517 A1 Nov. 10, 2011

(30) Foreign Application Priority Data

Mar. 10, 2010 (JP) ..... 2010-053746

(51) Int. Cl.
*B65H 37/04* (2006.01)
*B65H 37/06* (2006.01)

(52) U.S. Cl.
USPC ..... 270/47; 270/32; 270/39.08; 270/45

(58) Field of Classification Search
USPC ..... 270/32, 37, 38, 39.08, 45, 47, 51
See application file for complete search history.

(56) References Cited

U.S. PATENT DOCUMENTS 5,021,837 A * 6/1991 Uto et al. ..... 399/405
5,137,265 A * 8/1992 Sato et al. ..... 270/58.12
7,497,425 B2 * 3/2009 Taguchi et al. ..... 270/37

FOREIGN PATENT DOCUMENTS

JP H07-69514 A 3/1995
JP 09-48545 2/1997
JP 2003-312929 A 11/2003
JP 2009-143702 A 7/2009
JP 2009-292636 A 12/2009
JP 2010-1109 A 1/2010
JP 2010-018437 A 1/2010

OTHER PUBLICATIONS

Notice of Reasons for Rejection issued to JP Application No. 2010-053746, drafted Jul. 5, 2012.
Notice of Reasons for Rejection issued to JP Application No. 2010-053746, mailed Apr. 16, 2012.
Office Action mailed Feb. 18, 2013 in corresponding Japanese Application No. 2010-053746.

* cited by examiner

*Primary Examiner* — Patrick Mackey
(74) *Attorney, Agent, or Firm* — Knobbe Martens Olson & Bear LLP

(57) ABSTRACT

A sheet post-processing apparatus is provided that includes a first delivery path that guides a sheet to a first post-processing portion, a delivery holding path having a first holding path which branches off from a branch point of the first delivery path and a second holding path which is formed to be continuous with the first holding path and joins together with the first delivery path; a second delivery path that branches off from a branch point of the first holding path and guides the sheet to the second post-processing portion; a first path switching portion that is provided at the branch point of the first delivery path; and a second path switching portion that is provided at the branch point of the first holding path.

10 Claims, 5 Drawing Sheets

SHEET POST-PROCESSING APPARATUS WITH BRANCHED HOLDING PATH

This application is based on and claims the benefit of priority from Japanese Patent Application No. 2010-053746, filed on 10 Mar. 2010, the content of which is incorporated herein by reference.

BACKGROUND OF THE INVENTION

1. Field of the Invention

The present invention relates to a sheet post-processing apparatus that performs post-processing (stapling, booklet processing) on sheets on which an image is formed by an image forming apparatus such as an electrophotographic-type of copy machine, printer, or the like.

2. Related Art

Generally, a sheet post-processing apparatus that is attached to an image forming apparatus such as an electrophotographic-type of copy machine, printer, or the like has functions of collecting sheets on which an image is formed by way of an image forming apparatus so as to bind a stack of sheets thus collected at one place or at a plurality of places (staple processing) and binding the sheets on which images are formed in a magazine-like style (booklet processing). In addition, in order to improve the productivity of the image forming apparatus, the sheet post-processing apparatus has a holding path that allows the sheet delivered from the image forming apparatus to be held singularly or held by being stacked in plurality during stapling.

With the conventional technology, sheet post-processing apparatuses equipped with functions of stapling or booklet processing are configured to deliver the sheets on which images are formed by way of the image forming apparatus to a post-processing tray through a first delivery path and collect the sheets in the post-processing tray. A stack of sheets thus collected in the post-processing tray is bound at one place or a plurality of places by a stapler (stapling). Furthermore, the conventional sheet post-processing apparatus includes a second delivery path (delivery holding path) that branches off from the first delivery path. Then, one or a plurality of sheets is also held in the second delivery path while stapling. Moreover, the sheet post-processing apparatus includes a third delivery path that branches off from the first delivery path. Then, the sheet post-processing apparatus delivers via the third delivery path the sheets on which images are formed to an apparatus that performs booklet processing.

In the sheet post-processing apparatus, switching to the first delivery path, the delivery holding path, or the third delivery path is performed by a plurality of switching means (flappers) that is provided in a dedicated space at a delivering entrance side of the sheet post-processing apparatus.

However, in the conventional technology, a switching means that connects the third delivery path with the apparatus that performs booklet processing is provided in a dedicated space at a delivering entrance side of the sheet. Therefore, the horizontal width of the sheet post-processing apparatus increases. On the other hand, attempting to suppress the increase in the horizontal width of the sheet post-processing apparatus leads to another problem in that it is not possible to deliver cardboard sufficiently since the radius of curvature of the second delivery path will be small.

Furthermore, in the conventional technology, the first delivery path, the delivery holding path, and the third delivery path are formed independently. As a result, there is also a problem in that the cost of forming the first delivery path, the delivery holding path, and the third delivery path increases and the space for forming the same becomes large.

SUMMARY OF THE INVENTION

In view of the abovementioned problems, it is an object of the present invention to provide a sheet post-processing apparatus attached to an image forming apparatus that is capable of reducing the size of the apparatus, reducing the cost, and further maintaining delivery performance regardless of the type of sheet.

According to a first aspect of the present invention, a sheet post-processing apparatus is provided which is equipped with a first post-processing portion that collects sheets delivered from an image forming apparatus and performs first post-processing, and a second post-processing portion that performs second post-processing on the sheets delivered from the image forming apparatus, the apparatus comprising: a first delivery path that guides the sheet delivered from the image forming apparatus to the first post-processing portion; a sheet holding path having a first holding path which branches off from a branch point of the first delivery path and a second holding path which is formed to be continuous with the first holding path and joins together with the first delivery path, the sheet holding path allowing the sheet delivered to the first post-processing portion to be held at the first holding path and the second holding path; a second delivery path that branches off from a branch point of the first holding path and guides the sheet delivered to the first holding path to the second post-processing portion; a first path switching portion that is provided at the branch point of the first delivery path and selectively switches to connect the first delivery path to the first holding path or the first delivery path on a side thereof at the first post-processing portion; and a second path switching portion that is provided at the branch point of the first holding path and selectively switches to connect the first holding path to the second holding path or the second delivery path.

According to a second aspect of the present invention, a sheet post-processing apparatus is provided which is equipped with a first post-processing portion that collects sheets delivered from an image forming apparatus and performs first post-processing, and a second post-processing portion that performs second post-processing on the sheets delivered from the image forming apparatus, the apparatus comprising: a first delivery path that guides the sheet delivered from the image forming apparatus to the first post-processing portion; an ejection delivery path that branches off from the first branch point of the first delivery path and guides the sheet thus delivered to an ejection portion; a sheet holding path having a first holding path which branches off from a second branch point that is located more on a downstream side than the first branch point of the first delivery path and a second holding path which is formed to be continuous with the first holding path and joins together with the first delivery path, the sheet holding path allowing the sheet delivered to the first post-processing portion to be held at the first holding path and the second holding path; a second delivery path that branches off from a branch point of the first holding path and guides the sheet delivered to the first holding path to the second post-processing portion; an ejection path switching portion that is provided at a first branch portion of the first delivery path and selectively switches to connect the first delivery path to the ejection delivery path or the first delivery path on a side thereof at the second branch point; a first path switching portion that is provided at the second branch point of the first delivery path and selectively switches to connect the first delivery path to the first holding path or to a side thereof at the first post-processing portion; and a second path switching portion that is provided at the branch point of the first holding path and selectively switches to connect the first holding path to the second holding path or the second delivery path.

According to the present invention, it is possible to configure a delivery path that guides the sheet to the second post-processing portion with the first holding path and the second delivery path. Furthermore, it is possible to configure a delivery path that allows the sheet to be held with the first holding path and the second holding path.

In this way, the delivery path that delivers the sheet to the second post-processing portion can be employed as the sheet holding path at the first holding path. Accordingly, it is possible to reduce the cost for forming the delivery path and the space for forming the same, a result of which a reduction in the size of the sheet post-processing apparatus can be achieved.

In addition, the radius of curvature of the delivery path that delivers the sheet to the second post-processing portion can be made larger, even when aiming to reduce the size of the sheet post-processing apparatus. Consequently, it is possible to suitably guide and deliver various sheets of different thickness, specifically cardboard.

Moreover, the first path switching portion and the second path switching portion are provided at the branch point of the first delivery path and the branch point of the first holding path, respectively. Therefore, dedicated spaces for providing the first path switching portion and the second path switching portion are not necessary. In this way, a reduction in the size of the sheet post-processing apparatus can be achieved.

Furthermore, according to the present invention, it is possible to configure the delivery path that guides the sheet to the second post-processing portion with the first holding path and the second delivery path. Furthermore, it is possible to configure the delivery path that allows the sheet to be held with the first holding path and the second holding path.

In this way, the delivery path that delivers the sheet to the second post-processing portion can be employed as the sheet holding path at the first holding path. Consequently, it is possible to reduce the cost for forming the delivery path and the space for forming the same, a result of which a reduction in the size of the sheet post-processing apparatus can be achieved.

In addition, the radius of curvature of the delivery path that delivers the sheet to the second post-processing portion can be made larger, even when aiming at reducing the size of the sheet post-processing apparatus. Therefore, it is suitably possible to guide and deliver various sheets of different thickness, specifically cardboard.

Furthermore, the ejection path switching portion, the first path switching portion, and the second path switching portion are provided at the branch portion of the first delivery path and the branch portion of the first holding path, respectively. Therefore, dedicated spaces for providing the first path switching portion and the second path switching portion are not necessary. In this way, a reduction in the size of the sheet post-processing apparatus can be achieved.

In addition, in a case in which the first post-processing or the second post-processing is not performed, the sheet post-processing apparatus can also be applied to a configuration having a function of ejecting a sheet delivered from the image forming apparatus to an ejection portion.

In addition, according to the present invention, the first post-processing portion can perform stapling on the sheets thus collected and the second post-processing portion can perform booklet processing on the sheets thus delivered. Therefore, it is possible to bind the sheets delivered from the image forming apparatus at one place or a plurality of places (staple) or bind in a magazine-like style (booklet).

DETAILED DESCRIPTION OF THE INVENTION

In the following, a sheet post-processing apparatus according to the present invention is described with reference to the drawings.

Figure 1:
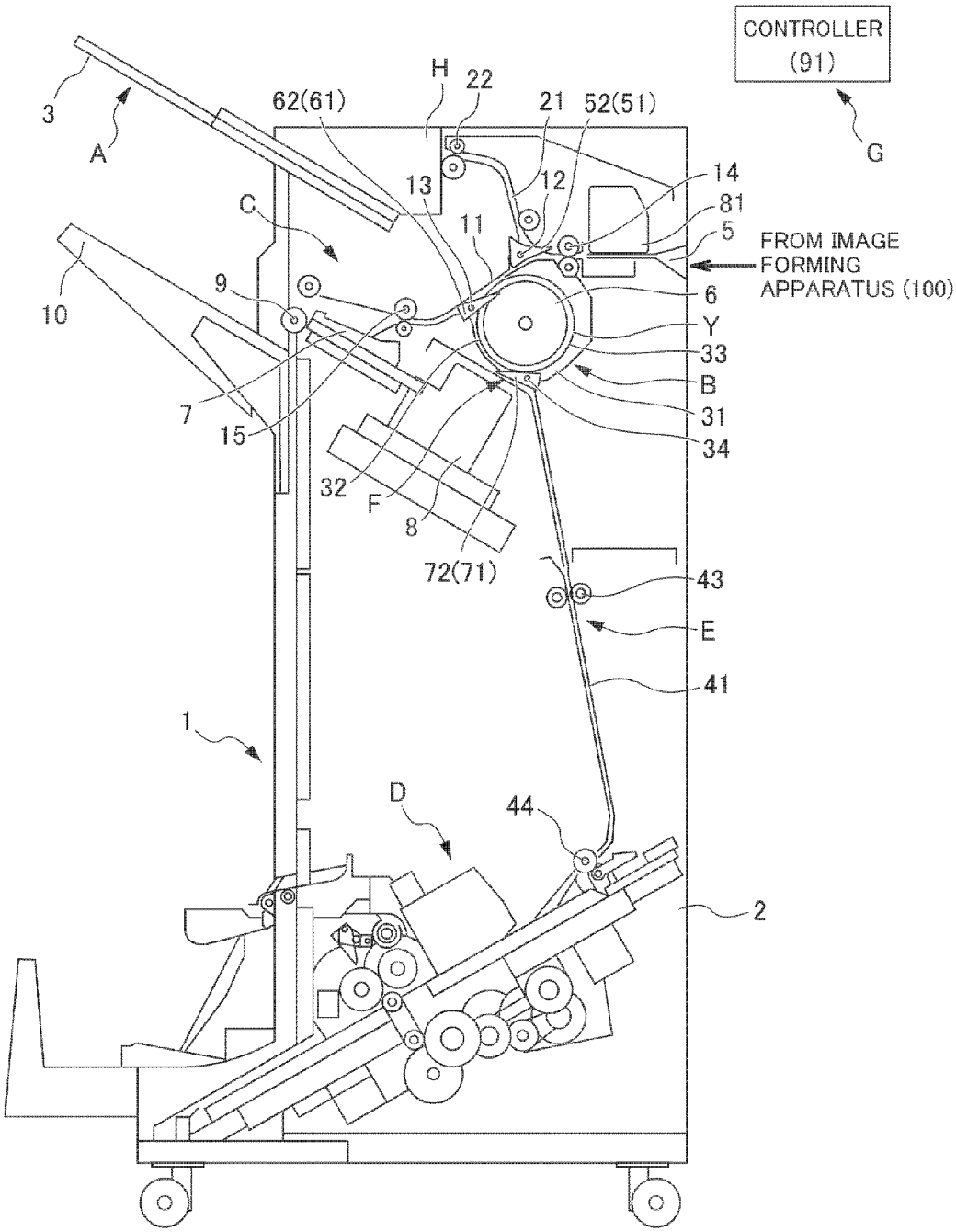
FIG. 1 is a configurational diagram of a sheet post-processing apparatus according to the present invention.
Figure 2:
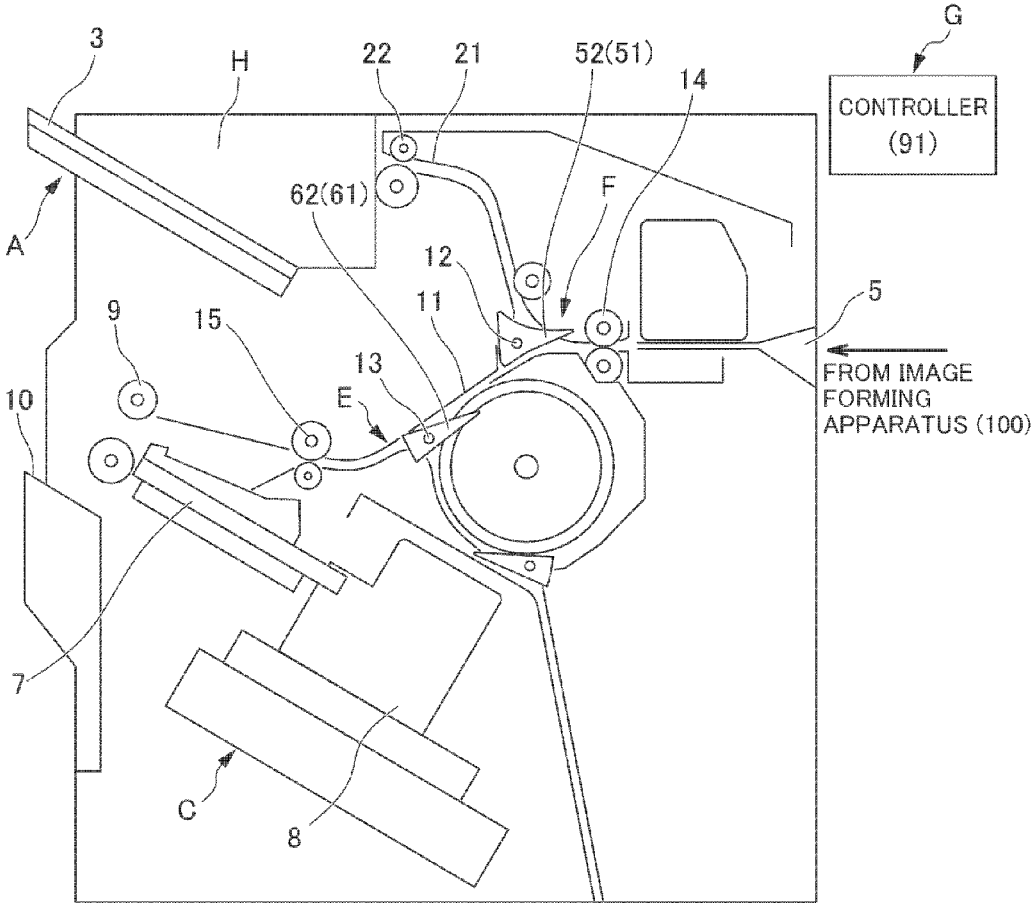
FIG. 2 is a diagram showing an operation of the sheet post-processing apparatus of FIG. 1, and is an enlarged view of a substantial part showing a state in which a sheet is delivered to a first post-processing portion.
Figure 3:
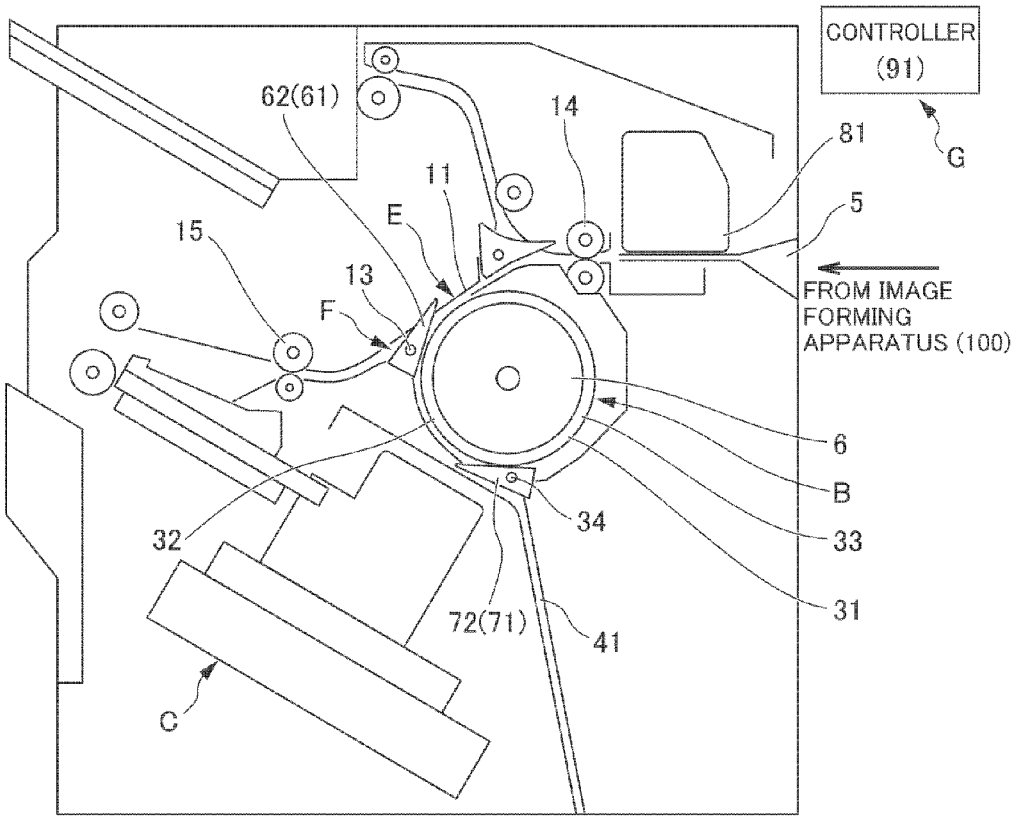
FIG. 3 is a diagram showing an operation of the sheet post-processing apparatus of FIG. 1, and is an enlarged view of a substantial part showing a state in which a sheet is held.
Figure 4:
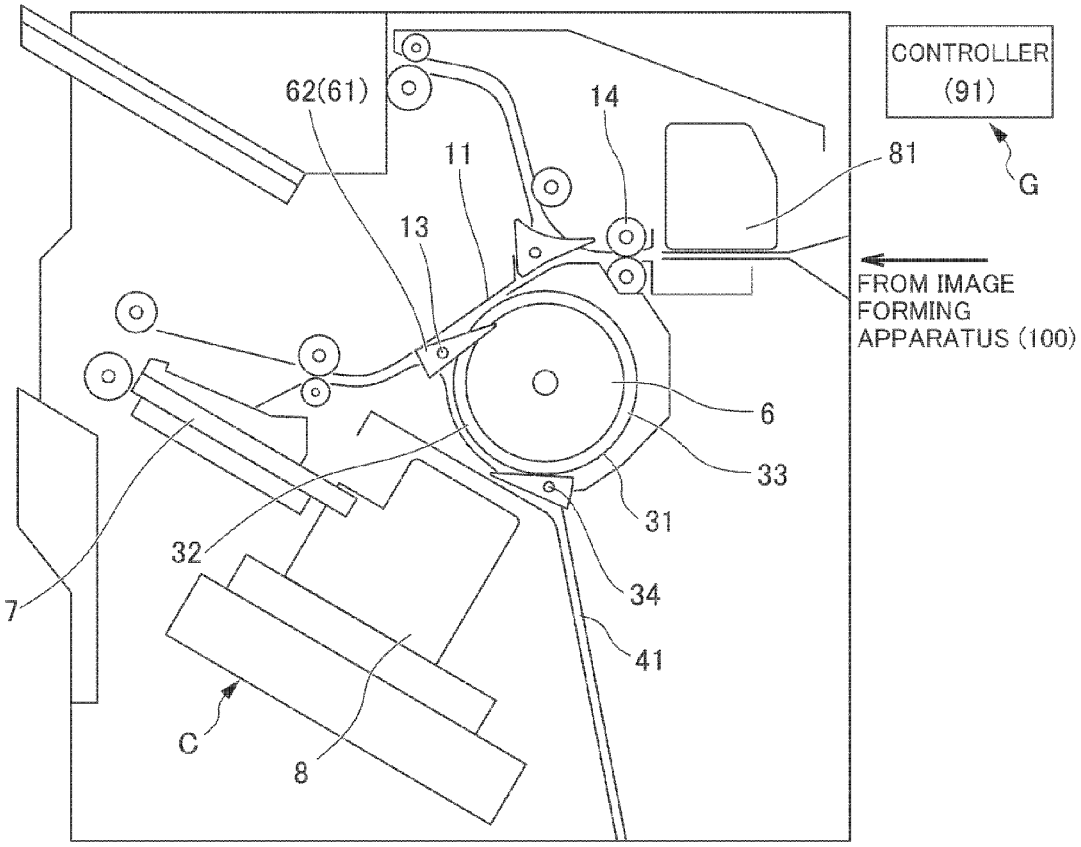
FIG. 4 is a diagram showing an operation of the sheet post-processing apparatus of FIG. 1, and is an enlarged view of a substantial part showing a state in which a sheet and a sheet being held are stacked.
Figure 5:
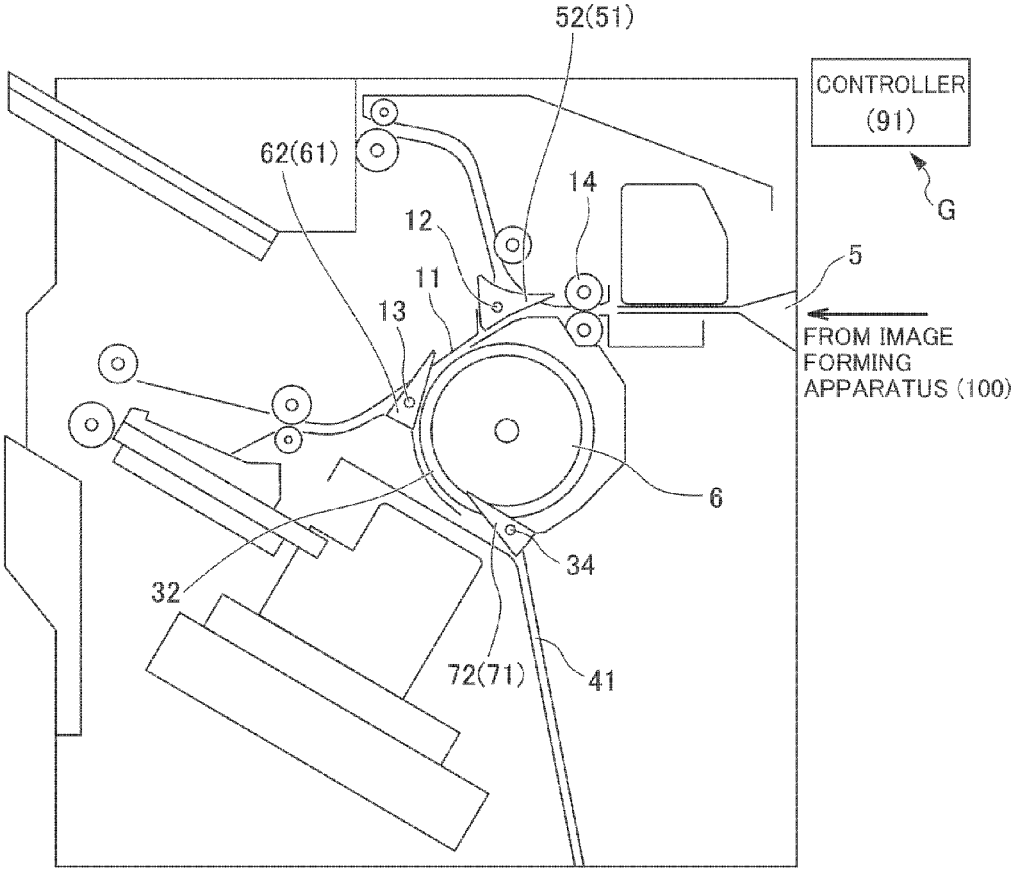
FIG. 5 is a diagram showing an operation of the sheet post-processing apparatus of FIG. 1, and is an enlarged view of a substantial part showing a state in which a sheet is delivered to a second post-processing portion.

FIG. 1 is a configurational diagram of a sheet post-processing apparatus according to the present invention. FIG. 2 is a diagram showing an operation of the sheet post-processing apparatus of FIG. 1, and is an enlarged view of a substantial part showing a state in which a sheet is delivered to a first post-processing portion. FIG. 3 is a diagram showing an operation of the sheet post-processing apparatus of FIG. 1, and is an enlarged view of a substantial part showing a state in which a sheet is held. FIG. 4 is a diagram showing an operation of the sheet post-processing apparatus of FIG. 1, and is an enlarged view of a substantial part showing a state in which a sheet and a sheet being held are stacked. FIG. 5 is a diagram showing an operation of the sheet post-processing apparatus of FIG. 1, and is an enlarged view of a substantial part showing a state in which a sheet is delivered to a second post-processing portion.

In FIG. 1, a sheet post-processing apparatus (1) is attached to an image forming apparatus (100). As shown in FIG. 1, the sheet post-processing apparatus (1) performs first post-processing or second post-processing on a sheet on which an image is formed (hereinafter, referred to as the sheet) that is delivered from the image forming apparatus (100). The first post-processing refers to stapling and the second post-processing refers to booklet processing.

As shown in FIG. 1, the sheet post-processing apparatus (1) is configured to include an apparatus main body (2), an ejection portion (A), a hold and drive portion (B), a first post-processing portion (C), a second post-processing portion (D), a delivery path portion (E), a path switching portion (F), and a control portion (G).

Ejection Portion (A)

As shown in FIG. 1, the ejection portion (A) is disposed at an upper external side of the apparatus main body (2), and includes an ejection space (H). The ejection portion (A) is provided with an ejection tray (3) that is disposed in the ejection space (H). As shown in FIG. 1, the ejection tray (3) collects sheets ejected from the apparatus main body (2).

Hold and Drive Portion (B)

As shown in FIG. 1, the hold and drive portion (B) is disposed proximal to a delivering entrance (5) disposed at an upper side in the apparatus main body (2). As shown in FIG. 1, the hold and drive portion (B) is provided with a cylindrical space (Y) and a buffer roller (6). The buffer roller (6) is mounted in the cylindrical space (Y) to form a gap. Furthermore, the buffer roller (6) is coupled with a drive motor (not illustrated) and is rotationally driven by the drive motor.

First Post-Processing Portion (C)

As shown in FIG. 1, the first post-processing portion (C) is disposed at an upper side in the apparatus main body (2) and on a downstream side of the hold and drive portion (B). The first post-processing portion (C) performs stapling on sheets delivered from the image forming apparatus (100). Furthermore, as shown in FIG. 1, the first post-processing portion (C) includes a processing tray (7) that collects sheets, and a stapler (8). The stapler (8) binds the sheets thus collected in the processing tray (7) at one place or a plurality of places (stapling).

As shown in FIG. 1, the sheets on which stapling is performed are ejected by way of a pair of delivery rollers (9) to an ejection tray (10) that is disposed outside of the apparatus main body (2).

Second Post-Processing Portion (D)

As shown in FIG. 1, a second post-processing portion (D) is disposed in the apparatus main body (2), at lower side of the hold and drive portion (B). The second post-processing portion (D) performs booklet processing on the sheets delivered from the image forming apparatus (100). It should be noted that booklet processing refers to binding the sheets in a magazine-like style.

As shown in FIG. 1, the sheets on which booklet processing is performed are ejected to the outside from the lower side of the apparatus main body (2).

Delivery Path Portion (E)

As shown in FIG. 1, the delivery path portion (E) is formed in the apparatus main body (2). The delivery path portion (E) is configured with a first delivery path (11), an ejection delivery path (21), a sheet holding path (31), and a second delivery path (41).

As shown in FIG. 1, the first delivery path (11) is formed between a delivering entrance (5) of the apparatus main body (2) and the first post-processing portion (C). As shown in FIG. 1, the first delivery path (11) includes a first branch point (12) and a second branch point (13), which is disposed more towards a downstream side than the first branch point (12). Then, the cylindrical space (Y) of the hold and drive portion (B) is formed between the first branch point (12) and the second branch point (13). Furthermore, the first delivery path (11) is in communication with the cylindrical space (Y). The outer circumference of the buffer roller (6) is located in the first delivery path (11). In addition, as shown in FIG. 1, a plurality of pairs of delivery rollers (14) and (15) is disposed in the first delivery path (11).

As shown in FIG. 1, the first delivery path (11) guides the sheets delivered from the delivering entrance (5) of the apparatus main body (2) to the first post-processing portion (C). In addition, as shown in FIG. 1, the sheets delivered from the delivering entrance (5) are delivered up to the first post-processing portion (C) by way of rotationally driving the plurality of pairs of delivery rollers (14) and (15).

As shown in FIG. 1, the ejection delivery path (21) branches off from the first branch point (12) of the first delivery path (11). The ejection delivery path (21) is formed between the first branch point (12) and the ejection space (H) of the ejection portion (A). Furthermore, as shown in FIG. 1, a pair of delivery rollers (22) is disposed in the ejection delivery path (21).

As shown in FIG. 1, the ejection delivery path (21) guides the sheets delivered from the first branch point 12 of the first delivery path (11) to the ejection tray (3) of the ejection portion (A). Furthermore, as shown in FIG. 1, the sheets delivered to the ejection delivery path (21) are delivered up to the ejection portion (A) by way of rotationally driving the pair of delivery rollers (22).

As shown in FIG. 1, the sheet holding path (31) includes a first holding path (32) and a second holding path (33). As shown in FIG. 1, the first holding path (32) and the second holding path (33) are formed by the gap between the cylindrical space (Y) of the hold and drive portion (B) and the buffer roller (6), and are disposed along the outer circumference of the buffer roller (6).

As shown in FIG. 1, the first holding path (32) branches off from the second branch point (13), which serves as a branch point of the first delivery path (11). Furthermore, as shown in FIG. 1, the first holding path (32) has a branch point (34) at a position located at an upper side of the second post-processing portion (D).

As shown in FIG. 1, the second holding path (33) is formed to be continuous from the branch point (34) of the first holding path (32) and joins together with the first delivery path (11) at a location between the first branch point (12) and the second branch point (13).

As shown in FIG. 1, the sheet holding path (31) is formed in the middle of the first delivery path (11) (between the first branch point (12) and the second branch point (13)).

As shown in FIG. 1, the sheet holding path (31) guides the sheet delivered to the first holding path (32) by rotationally driving the buffer roller (6) and temporarily holds the sheet at the first holding path (32) and the second holding path (33). That is, the sheet holding path (31) allows the sheet delivered to the first post-processing portion (C) to be temporarily held.

Furthermore, as shown in FIG. 1, the sheet holding path (31) guides the sheet which is held at the sheet holding path (31) to the first delivery path (11) by way of rotationally driving the buffer roller (6).

As shown in FIG. 1, the second delivery path (41) branches off from the branch point (34) of the first holding path (32). The second delivery path (41) is formed between the branch point (34) and the second post-processing portion (D).

Furthermore, as shown in FIG. 1, a plurality of pairs of delivery rollers (43) and (44) is disposed in the second delivery path (41).

As shown in FIG. 1, the second delivery path (41) guides the sheet delivered from the first holding path (32) to the second post-processing portion (D). Furthermore, the sheet delivered to the second delivery path is delivered up to the second post-processing portion (D) by way of rotationally driving the plurality of a pair of rollers (43) and (44).

As shown in FIG. 1, the delivery path portion (E) with the abovementioned configuration configures a delivery path that guides the sheet to the second post-processing portion (D) by the first holding path (32) and the second delivery path (41). Furthermore, as shown in FIG. 1, the sheet holding path that allows the sheet to be held is configured by the first holding path (32) and the second holding path (33).

In this way, the delivery path that guides the sheet to the second post-processing portion (D) can be employed as the sheet holding path (31) at the first holding path (32).

Accordingly, it is possible to reduce the cost for forming the delivery path and a space for forming the same, a result of which a reduction in the size of the apparatus main body (2) can be achieved.

In addition, the radius of curvature of the delivery path that guides the sheet to the second post-processing portion (D) can be made larger, even if reducing the size of the apparatus main body (2). Accordingly, it is possible to deliver various sheets of different thickness, specifically cardboard, to the second post-processing portion (D) preferably.

Path Switching Portion (F)

As shown in FIG. 1, a path switching portion (F) is disposed in the apparatus main body (2). The path switching portion (F) includes an ejection path switching portion (51), a first path switching portion (61), and a second path switching portion (71).

As shown in FIG. 1, the ejection path switching portion (51) is configured with a switching guide (52) that is pivotally supported to be swingable and is provided at the first branch point (12) of the first delivery path (11).

As shown in FIG. 1, the switching guide (52) is configured to selectively switch to connect the first delivery path (11), which is located more on an upstream side than the first branch point (12), to the ejection delivery path (21) or the first delivery path (11) that is located on a side thereof at the second branch point (13). By switching of the switching guide (52), the sheet delivered from the image forming apparatus (100) can be delivered either to the ejection portion (A) or the first post-processing portion (C).

As shown in FIG. 1, the first path switching portion (61) is configured with a switching guide (62) that is pivotally supported to be swingable and is provided at the second branch point (13) of the first delivery path (11).

As shown in FIGS. 2 and 3, the switching guide (62) is configured to selectively switch to connect the first delivery path (11), which is located more on an upstream side than the second branch point (13), to the first holding path (32) or the first delivery path (11) that is located on a side thereof at the first post-processing portion (C). By switching of the switching guide (62), the sheet delivered can be delivered either to the sheet holding path (31) or the first delivery path (11) on a side thereof at the first post-processing portion (C).

As shown in FIG. 1, the second path switching portion (71) is configured with the switching guide (72) that is pivotally supported to be swingable and is provided at the branch point (34) of the first holding path (32).

As shown in FIGS. 3 and 5, the switching guide (72) is configured to selectively switch to connect the first holding path (32) to the second holding path (33) or the second delivery path (41). By switching of the switching guide (72), the sheet delivered to the first holding path (32) can be delivered either to the second holding path (33) or the second delivery path (41).

As shown in FIG. 1, the path switching portion (F) with the abovementioned configuration includes the switching guides (52), (62), and (72) that are disposed at the first branch point (12) and the second branch point (13) in the first delivery path (11), and the branch point (34) of the first holding path (32), respectively.

In this way, since dedicated spaces for providing the switching guides (52), (62), and (72) are not necessary, a reduction in the size of the apparatus main body (2) can be achieved.

Control Portion (G)

As shown in FIG. 1, the control portion (G) includes a feed sensor (81) and a controller (91).

As shown in FIG. 1, the feed sensor (81) is disposed in the apparatus main body (2) and between the delivering entrance (5) and the first branch point (12). As shown in FIG. 1, the feed sensor (81) detects a sheet that passes through the first delivery path (11) at a side of the delivering entrance (5), and outputs the detected result as a detection signal to the controller (91).

As shown in FIG. 1, the controller (91) controls drive and rotation of the buffer roller (6), rotational drive of the plurality of pairs of delivery rollers (14), (15), (22), (43), (44), and switching operations of each switching guide (52), (62), and (72) based on a detection signal of the feed sensor (81) and an operational instruction (stapling instruction, booklet processing instruction) by an operator (user).

Next, a stapling operation, a sheet holding operation, a booklet processing operation, and an ejection operation that are performed in the sheet post-processing apparatus (1) are described with reference to FIGS. 1 to 5.

Stapling Operation

When a staple processing instruction is inputted through an operation by an operator (user), as shown in FIG. 2, the controller (91) outputs a switching instruction to the switching guides (52) and (62), which are located at the first branch point (12) and the second branch point (13) of the first delivery path (11), respectively.

As shown in FIG. 2, the switching guide (52) switches and connects the first delivery path (11), which is located more on an upstream side than the first branch point (12), to a side of the second branch point (13) based on the switching instruction. Furthermore, as shown in FIG. 2, the switching guide (62) switches and connects the first delivery path (11), which is located more on an upstream side than the second branch point (13), to a side of the first post-processing portion (C) based on the switching instruction.

In this way, as shown in FIG. 2, the first delivery path (11) is connected between the delivering entrance (5) of the apparatus main body (2) and the first post-processing portion (C).

Furthermore, as shown in FIG. 2, the controller (91) drives the plurality of pairs of delivery rollers (14) and (15) to rotate.

As shown in FIG. 2, the sheet delivered from the image forming apparatus (100) is guided by the first delivery path (11) and delivered up to the first post-processing portion (C) by rotationally driving the plurality of pairs of delivery rollers (14) and (15).

As shown in FIG. 2, the first post-processing portion (C) collects the sheets thus delivered in the processing tray (7), and, when a certain number of sheets have been collected, delivers the sheets thus collected in the processing tray (7) to the stapler (8).

Then, as shown in FIG. 2, the stapler (8) binds the sheets thus delivered at one place or at a plurality of places (stapling).

As shown in FIG. 1, the sheets to which stapling has been performed are ejected to the ejection tray (10) by way of rotationally driving the pair of delivery rollers (9).

Sheet Holding Operation

As shown in FIGS. 1 and 3, the controller (91) monitors the number of sheets to be delivered based on the detection signal of the feed sensor (81), and recognizes all of the sheet deliveries for staple processing. Subsequently, as shown in FIG. 2, when a staple signal is inputted from the first post-processing portion (C), the controller (91) recognizes that the first post-processing portion (C) is carrying out staple processing.

In this way, as shown in FIG. 3, the controller (91) performs the sheet holding operation.

As shown in FIG. 3, the controller (91) outputs a switching instruction to the switching guide (62) that is located at the second branch point (12) of the first delivery path (11) and to the switching guide (72) that is located at the branch point (34) of the first holding path (32).

As shown in FIG. 3, the switching guide (62) switches and connects the first delivery path (11), which is located at an upstream side of the second branch point (13), to a side of the first holding path (32) based on the switching instruction. Furthermore, as shown in FIG. 3, the switching guide (72) switches and connects the first holding path (32) to the second holding path (33) based on a switching instruction based on the switching instruction.

In this way, as shown in FIG. 3, the sheet holding path (31) is connected to the first delivery path (11) so as to be continuous.

Furthermore, as shown in FIG. 3, the controller (91) drives the buffer roller (6) of the hold and drive portion (B) to rotate.

As shown in FIG. 3, the sheet delivered from the image forming apparatus (100) is guided through the first delivery path (11), the holding path (32), and the second holding path (33), and is delivered to the sheet holding path (31) by way of rotationally driving the pair of delivery rollers (14) and the buffer roller (6).

Subsequently, as shown in FIG. 3, when the sheet is delivered to the first holding path (32) and the second holding path (33), the controller (91) stops the rotationally driving of the buffer roller (6).

In this way, it is possible to allow the sheet to be held at the sheet holding path (31) during stapling.

As shown in FIG. 3, when the sheet is held at the sheet holding path (31), the controller (91) outputs a switching instruction to the switching guide (62) that is located at the second branch point (13) of the first delivery path (11).

As shown in FIG. 4, the switching guide (62) is switched so as to connect the first delivery path (11), which is located more on an upstream side than the second branch point (13), to the first delivery path (11) that is located on a side of the first post-processing portion (C).

As shown in FIG. 4, when staple processing at the first post-processing portion (C) ends, the controller (91) monitors sheets that are delivered from the image forming apparatus (100) in a state in which the sheet is held in the sheet holding path (31). As shown in FIG. 4, this monitoring is performed based on the detection signal of the delivering sensor (81).

Subsequently, as shown in FIG. 4, when a detection signal is inputted from the feed sensor (81) and it is recognized that the sheet has been delivered to the first delivery path (11) from the image forming apparatus (100), the controller (91) drives the buffer roller (6) to rotate.

At this time, as shown in FIG. 4, the controller (91) delivers the sheet in the sheet holding path (31) to the first delivery path (11) so that the leading end of the sheet that is held at the sheet holding path (31) matches the leading end of the sheet delivered to the first delivery path (11), by controlling the start of the rotational drive and the revolution speed of the buffer roller (6).

In this way, as shown in FIG. 4, the sheet delivered in the first delivery path (11) and the sheet delivered to the first delivery path (11) from the sheet holding path (31) are stacked on an upstream side of the second branch point (13), guided through the first delivery path (11) by way of rotationally driving the buffer roller (6) and the pair of delivery rollers (14), and then delivered to the first post-processing portion (C).

The first post-processing portion (C) performs binding of the sheets that are stacked and delivered at one place or at a plurality of places (stapling).

Booklet Processing Operation

When a booklet processing instruction is inputted through an operation of an operator (user), as shown in FIG. 5, the controller (91) outputs a switching instruction to the switching guides (52) and (62), which are located at the first branch point (12) and the second branch point (13) of the first delivery path (11), respectively, and to the switching guide (72) that is located at the branch point (34) of the first holding path (32).

As shown in FIG. 5, the switching guide (52) is switched to connect the first delivery path (11), which is located more on an upstream side than the first branch point (12), to a side of the second branch point (13). Furthermore, as shown in FIG. 5, the switching guide (62) is switched to connect the first delivery path (11), which is located more on an upstream side than the second branch point (13), to the first holding path (32) based on the switching instruction. As shown in FIG. 5, the switching guide (72) is switched to connect the first holding path (32) to the second delivery path (41) based on the switching instruction.

In this way, as shown in FIG. 5, the first delivery path (11), the first holding path (32), and the second delivery path (41) are connected with each other to guide the sheet to the second post-processing portion (D).

Furthermore, as shown in FIGS. 1 and 5, the controller (91) drives the buffer roller (6) and the pair of delivery rollers (14) and (43) to rotate.

As shown in FIGS. 1 and 5, the sheet delivered from the image forming apparatus (100) is guided through the first delivery path (11), the first holding path (32), and the second delivery path (41), and then delivered up to the second post-processing portion (D) by way of rotationally driving the buffer roller (6) and the pair of delivery rollers (14) and (43).

As shown in FIG. 1, the second post-processing portion (D) performs binding of a plurality of sheets in a magazine-like style (booklet processing).

As shown in FIG. 1, the sheets to which booklet processing is performed are ejected to the outside from the lower side of the apparatus main body (2).

Ejection Operation

As shown in FIG. 1, in a case in which a stapling instruction or booklet processing instruction is not inputted, the controller (91) outputs a switching instruction to the switching guide (52) that is located at the first branch point (12) of the first delivery path (11).

As shown in FIG. 1, the switching guide (52) is switched to connect the first delivery path (11), which is located more on an upstream side than the first branch point (12), to the ejection delivery path (21).

In this way, as shown in FIG. 1, the ejection delivery path (21) is connected to the first delivery path (11).

As shown in FIG. 1, the sheet delivered from the image forming apparatus (100) is guided through the first delivery path (11) and the ejection delivery path (21), and then delivered up to the ejection portion (A) by rotationally driving the pair of delivery rollers (14) and the pair of delivery rollers (22).

As shown in FIG. 1, the ejection portion (A) collects the sheets in the ejection tray (3) inside the ejection space (H).

INDUSTRIAL APPLICABILITY

The present invention is preferably used for a sheet post-processing apparatus that performs post-processing (stapling, booklet processing) to a sheet on which an image has been formed by way of an image forming apparatus.

What is claimed is:

1. A sheet post-processing apparatus comprising:

a first post-processing portion that collects sheets delivered from an image forming apparatus and performs first post-processing;

a second post-processing portion that performs second post-processing on the sheets delivered from the image forming apparatus;

an entrance through which the sheets delivered image forming apparatus are brought in;

a first delivery path that guides the sheet delivered through the entrance to the first post-processing portion;

a sheet holding path having a first holding path which branches off from a branch point of the first delivery path and a second holding path which is formed to be continuous with the first holding path and joins together with the first delivery path, the sheet holding path allowing the sheet delivered to the first post-processing portion to be held at the first holding path and the second holding path;

a second delivery path that branches off from a branch point of the first holding path and guides the sheet delivered to the first holding path to the second post-processing portion;

a buffer roller disposed proximity to the entrance, an upper end of the buffer roller being close to a lower portion of the first delivery path, and the first holding path and the second holding path being disposed along an external circumference of the buffer roller;

a first path switching portion that is provided at the branch point of the first delivery path and selectively switches to connect the first delivery path to the first holding path or the first delivery path on a side of the first post-processing portion; and a second path switching portion that is provided at the branch point of the first holding path and selectively switches to connect the first holding path to the second holding path or the second delivery path.

2. A sheet post-processing apparatus comprising:

a first post-processing portion that collects sheets delivered from an image forming apparatus and performs first post-processing;

a second post-processing portion that performs second post-processing on the sheets delivered from the image forming apparatus;

an entrance through which the sheets delivered from the image forming apparatus are brought in;

a first delivery path that guides the sheet delivered through the entrance to the first post-processing portion;

an ejection delivery path that branches off from a first branch point of the first delivery path and guides the sheet thus delivered to an ejection portion;

a sheet holding path having a first holding path which branches off from a second branch point that is located more on a downstream side than the first branch point of the first delivery path and a second holding path which is formed to be continuous with the first holding path and joins together with the first delivery path, the sheet holding path allowing the sheet delivered to the first post-processing portion to be held at the first holding path and the second holding path;

a second delivery path that branches off from a branch point of the first holding path and guides the sheet delivered to the first holding path to the second post-processing portion;

a buffer roller disposed proximity to the entrance, an upper end of the buffer roller being close to a lower portion of the first delivery path, and the first holding path and the second holding path being disposed along an external circumference of the buffer roller;

an ejection path switching portion that is provided at the first branch portion of the first delivery path and selectively switches to connect the first delivery path to the ejection delivery path or the first delivery path on a side of the second branch point;

a first path switching portion that is provided at the second branch point of the first delivery path and selectively switches to connect the first delivery path to the first holding path or toward the first post-processing portion; and a second path switching portion that is provided at the branch point of the first holding path and selectively switches to connect the first holding path to the second holding path or the second delivery path.

3. The sheet post-processing apparatus according to claim 1, wherein the first post-processing portion performs stapling on the sheets thus collected and the second post-processing portion performs booklet processing on the sheet thus delivered.

4. The sheet post-processing apparatus according to claim 2, wherein the first post-processing portion performs stapling on the sheet thus collected and the second post-processing portion performs booklet processing on the sheet thus delivered.

5. The sheet post-processing apparatus according to claim 1, wherein the first delivery path is configured to be substantially horizontal from the entrance to an adjacent portion where the upper end of the buffer roller is close to the first delivery path.

6. The sheet post-processing apparatus according to claim 5, further comprising an ejection tray to which the sheets after the first post-processing are discharged, wherein a direction of a discharging path from the adjacent portion to the ejection tray and a direction of the second delivery path are configured to intersect with each other.

7. The sheet post-processing apparatus according to claim 6, wherein the first post-processing portion comprises a stapler that is located between the discharging path and the second delivery path.

8. The sheet post-processing apparatus according to claim 2, wherein the first delivery path is configured to be substantially horizontal from the entrance to an adjacent portion where the upper end of the buffer roller is close to the first delivery path.

9. The sheet post-processing apparatus according to claim 8, further comprising an ejection tray to which the sheets after the first post-processing are discharged, wherein a direction of a discharging path from the adjacent portion to the ejection tray and a direction of the second delivery path are configured to intersect with each other.

10. The sheet post-processing apparatus according to claim 9, wherein the first post-processing portion comprises a stapler that is located between the discharging path and the second delivery path.

* * * * *